US009982493B2

(12) United States Patent
Loviknes et al.

(10) Patent No.: US 9,982,493 B2
(45) Date of Patent: May 29, 2018

(54) THERMALLY EXPANDABLE CASING COLLAR

(71) Applicant: VANGUARD OIL TOOLS & SERVICES LLC, Muscat (OM)

(72) Inventors: Borre Loviknes, Nordfjordeid (NO); Mats Johansson, Gallivare (SE); Len Barton, Central Scotland (GB)

(73) Assignee: VANGUARD OIL TOOLS & SERVICES LLC, Muscat (OM)

( * ) Notice: Subject to any disclaimer, the term of this patent is extended or adjusted under 35 U.S.C. 154(b) by 517 days.

(21) Appl. No.: 14/416,607

(22) PCT Filed: Jul. 22, 2013

(86) PCT No.: PCT/IB2013/056008
§ 371 (c)(1),
(2) Date: Jan. 22, 2015

(87) PCT Pub. No.: WO2014/016758
PCT Pub. Date: Jan. 30, 2014

(65) Prior Publication Data

US 2015/0167401 A1 Jun. 18, 2015

(30) Foreign Application Priority Data

Jul. 22, 2012 (OM) ..... OM/P/2012/00156
Nov. 27, 2012 (SE) ..... 1251340

(51) Int. Cl.
*E21B 17/08* (2006.01)
*E21B 17/07* (2006.01)

(52) U.S. Cl.
CPC ..... *E21B 17/08* (2013.01); *E21B 17/07* (2013.01)

(58) Field of Classification Search
CPC ..... E21B 17/08; E21B 17/07; E21B 17/00; E21B 17/02; E21B 17/16
See application file for complete search history.

(56) References Cited

U.S. PATENT DOCUMENTS 2,899,218 A * 8/1959 Creighton ..... E21B 17/08 285/302
5,018,581 A 5/1991 Hall
2009/0283256 A1 11/2009 Langeslag

OTHER PUBLICATIONS

PCT International Search Report issued in PCT/IB2013/056008 dated Sep. 17, 2014.

(Continued)

*Primary Examiner* — Wei Wang
(74) *Attorney, Agent, or Firm* — Knobbe, Martens, Olson & Bear, LLP

(57) ABSTRACT

A joint element connects casing sections of a casing string for transporting fluids and/or gases. The joint element includes a first longitudinal part arranged to be at least partly overlapping a second longitudinal part or a casing section. The first longitudinal part is connected with the second longitudinal part or with the casing sections in a mounted state with the first longitudinal part adapted to move axially relative to the second longitudinal part or the casing sections in an operative state. The joint element includes at least one shear member with a predefined shear value and the shear member is adapted to shear when an axial force exceeding the total shear value of the shear member is exerted, allowing a relative axial movement between the first longitudinal part and the second longitudinal part or the casing sections.

12 Claims, 10 Drawing Sheets

(56) References Cited

OTHER PUBLICATIONS

Office Action dated Nov. 20, 2017 in corresponding Oman Patent Application No. OM/P/2015/00014—4 pages.

* cited by examiner

THERMALLY EXPANDABLE CASING COLLAR

CROSS-REFERENCE TO RELATED APPLICATIONS

This application is the U.S. National Phase under 35. U.S.C. § 371 of International Application PCT/IB2013/056008, filed Jul. 22, 2013, which claims priority to Omani Patent Application No. OM/P/2012/00156, filed Jul. 22, 2012 and Swedish Patent Application No. 1251340-4, filed Nov. 27, 2012. The disclosures of the above-described applications are hereby incorporated by reference in their entirety.

TECHNICAL FIELD

This application relates to a joint element for a casing string for transporting fluids, such as liquids, gases, cement, etc. More specifically, this application relates to a joint element for connecting a number of casing sections of a casing string in a well bore for production of hydrocarbons or for wells used for injection of steam to increase the production of hydrocarbons in heavy oil applications, although other areas of use of the invention are also conceivable. According to other aspects the present invention also relates to a casing string comprising a number of casing sections and a joint element for connecting said casing sections. In further aspects the invention relates to a method for compensating of forces due to thermal effects in a casing string comprising at least one casing section and at least one joint element. In yet further aspects the invention relates to a use of a joint element in a casing string for transporting fluids, such as liquids, gases, cement etc, in an oil well.

BACKGROUND OF THE INVENTION

An oil or gas well are normally built up by a number of steel casings in various sizes, with the largest diameter closest to the surface, and thereafter smaller sizes with increasing depth of the well, to the final production casing through the reservoir. Especially during injection of steam, the thermal expansion of the casing can over time cause large damages to the cemented casing that can reduce the production capacity of the well. In heavy oil applications, steam is often used to reduce the viscosity of the heavy oil by increasing the temperature on the reservoir/oil, to increase production.

During the process of completing an oil well for hydrocarbon production or injection purposes, a casing string will be run into the well bore. The casing is fabricated in sections, or joints, that are usually about 40 feet long and screwed together to form longer lengths of casings, called casing strings. Each end of the casing section has male (pin) threads and is connected by using a collar or coupling, composed of a short cylindrical steel pipe that is slightly larger in diameter than the casing sections and also has female (box) threads. The casing is run from the rig floor, connecting one section at the time by casing elevators on the travelling block and stabbed into the previous casing string that has been inserted into the well. Hanging above the drill floor, casing tongs screw each casing section to the casing string. After installation, the casing is cemented in place by pumping cement slurry through the inside of the casing and out into the annulus through the casing shoe at the bottom of the casing string. Once the casing has been run in the well, and cemented, it may be perforated to allow injection or production condition to occur. High temperatures and pressures can occur during this process which will affect the normal properties of the steel material in the casing. A problem with casing strings according to prior art, especially in the case of steam injection, is that the thermal expansion of the casing can cause different types of irreparable damages to the casing that will influence the production capacity of the casing. Consequently, there is a need for a well with a casing string which provides a continuous production capacity and which can be used at a low maintenance cost. There is also desired a casing string which is prevented from deforming due to thermal expansion or tensile forces. There is also desired a casing string in which axial forces and rotating torques are allowed to be transferred through the casing string during installation.

ASPECTS OF THE INVENTION

Aspects of the invention includes to provide a solution to the problems mentioned above and hence suggest an improved casing string in a well of the kind described. Features of the present invention include:

the capabilities to withstand the rotating torque during make-up and installation of the casing string which is a big advantage with the modern automated rigs that assembles/runs the casing strings to the well. This is achieved by shear members located in machined holes that locks the product in all directions. Also fixing members can be used to run in longitudinal slots to further enhance the ability to resist torque, the possibility to use the present invention in steam injection applications which gives very high casing expansions and contractions compared to conventional wells. Injected steam may have a temperature of up to 250-300° C. which creates large thermal effects on casing strings that may be 2-3000 meters long, the possibility to position the invention anywhere along the casing string, also direct in the production zone, the possibility to "stroke" the invention both ways, and to be able to set it up for different strokes such as "only compress", "only extend" or a combination of the two, some features of the present invention also will work in un-cemented applications.

The aforesaid aspects can be achieved embodiments by the present invention as defined in the independent claims 1, 12, 13 and 15. Suitable embodiments of the invention are set forth in the dependent claims.

Thus, there is defined a first embodiment in accordance with the present invention a joint element for connecting casing sections of a casing string for transporting liquids and/or gases. The joint element according to the invention is characterised in that it comprises at least two longitudinal parts, a first longitudinal part having a first end and a second end and a second longitudinal part having a first end and a second end, said first longitudinal part is arranged to be at least partly overlapping said second longitudinal part and said longitudinal parts are adapted to move axially relative to each other, said first end of said first longitudinal part and said second end of said second longitudinal part of the joint element are provided with connection means in order to be connected to an end of a respective casing section in a mounted state of the joint element.

The inventive joint element affords the benefit of allowing the casing string to expand or contract due to thermal effects and/or pressure effects when installed in the well. This will prevent the casing string from deforming, collapsing or buckling in a well bore.

According to one beneficial embodiment, said joint element is made of the steel. It can be the same steel material as casing section, but the joint element can of course also be manufactured in any other suitable material to give it the required pressure rating, exceeding the final casing pressure integrity test which is performed after the cement wiper plug has been pumped, displaced and landed on its profile inside the casing. The choice of material of the joint element can also depend on the chemical environment in the well.

According to another beneficial embodiment, said joint element comprises at least one shear member with a predefined shear value, said shear member is fixed on the first longitudinal part and on the second longitudinal part and said shear member is adapted to shear when an axial force due to thermal effects exceeding the total shear value of said shear member is exerted, allowing a relative axial movement between the first and second longitudinal parts the joint element. The benefit of this is that the at least two longitudinal parts of the joint element are held together by said at least one shear member. The at least one shear member is also locking the at least two longitudinal parts in axial and rotational direction until the casing string is assembled and the joint element is activated by an axial force exceeding the total shear value of said shear member. Hence, axial forces and rotating torques are allowed to be transferred through the element before it is activated. Preferably the shear value of the shear member is dimensioned to exceed the rotational torque that is needed to tighten the threaded connection between the longitudinal parts and respective casing section. The number of shear members and the material of the shear member can of course be adapted depending on the desired shear force value. A preferred material of the shear member is brass since brass has good shearing qualities, but as mentioned above, it can be adapted for the current situation. Other possible materials can be different types of steel materials, for example low strength or high strength steel.

According to another beneficial embodiment, said first longitudinal part comprises at least one fixing member with a first end fastened on the first longitudinal part and a second end positioned in a longitudinal slot or a cut-out extending in the longitudinal direction of the second longitudinal part, restricting the relative movements between the longitudinal parts. The benefit of this is that the relative movement between the longitudinal parts will be restricted. Said at least one fixing member will also prevent the casing string from parting once said at least one shear member is sheared. The position of said at least one fixing member can also be modified to adjust the direction and the length of the relative movement between the longitudinal parts. Since the at least one fixing member is positioned in a longitudinal slot or a radial cut-out in the first longitudinal part, rotating torques can be carried even after the shear member has been sheared. The fixing members can be positioned to allow for the joint element to only compress, or to allow it to elongate, or any combination of the two, depending on the application. The number of fixing members and the material of the fixing members can of course be adapted depending on the current application. A preferred material of the shear member is steel, for example high strength steel.

According to another beneficial embodiment, the joint element comprises at least one sealing member provided between said longitudinal parts of the joint element. In this way pressure integrity is allowed from the inside and the outside of the joint element once assembled in the casing string and during full stroke of the element. Hence, fluids and cement can be pumped through the internal bore and into the annulus without a leak path forming. A preferred material of the sealing members is HNBR-material, but in high temperatures or aggressive chemical environments, different types of elastomers can be used.

According to another beneficial embodiment said connection means provided on the first end of said first longitudinal part and on the second end of said second longitudinal part of the joint element is a threading. In this way the joint element will be connected to respective casing section and the threaded connections between the joint element and the casing sections will carry the tensile load of the casing string while it is being installed, in addition to give pressure integrity to the casing string. The threading is preferably provided on the inner periphery of the first end of the first longitudinal part and on the second end of the second longitudinal part, making the joint element replacing the normally used casing collar to connect the casing sections. But threading can of course be provided on the outer periphery of the first end of the first longitudinal part and/or on the outer periphery of the second end of the second longitudinal part. The joint element can replace the casing collar, normally used in this type of casing string, if the joint element has the same type of threads as said casing collar. Then the joint element can be assembled to the casing sections by using the normal assembly procedures and equipment as when the normal casing is run and requires no special equipment. The joint element can be provided with the same outer diameter as the casing collar, and the same inner diameter as the casing string. This allows for the normal cementing process, which can be done using normal cementing equipment. The joint element can in this way be placed anywhere along the casing string, also directly across the production zone, and can be used as a single unit, or in multiples to allow for the casing movement in the desired position along the casing string. Another benefit of the invention is that it can be cemented in place together with the casing string, still maintaining its function to allow for casing expansion or contraction.

According to another beneficial embodiment, said second longitudinal part is provided with a collar with a width defined by a first end and a second end. The beneficial with this is that the relative movement between the two longitudinal parts compressing the joint element is restricted by the distance between the first end of the collar of the second longitudinal part, and the second end of the first longitudinal part. This also provide for a relatively short stroke from a fully expanded state to a fully compressed state of the joint element. In the case the casing string is cemented in the well bore, the relatively short stroke results in less cement added to the stroke area and hence it is relatively easy to get rid of this cement during the compressing of the joint element. Since it is possible to add several joint elements to a casing string a sufficient stroke can be achieved to prevent deformation of the casing string.

According to another beneficial embodiment, said second end of said collar and said second end of said first longitudinal part is provided with a chamfer. In this way hardened cement can be forced away from the joint element, thereby allowing it to compress even after being cemented.

According to another beneficial embodiment, said first longitudinal part and for the second longitudinal part are/is provided with a receiving means. In this way the casing string can be retrieved by a pulling tool if for some reason the casing string has to be pulled out of the well bore. The receiving means has preferably an internal fish-neck profile on the first longitudinal part and/or the second longitudinal part.

In a further embodiment according to the present invention the casing section joint element is characterised in that it comprises one longitudinal part with a first end and a second end, said first end and said second end of said at least one longitudinal part is arranged to be at least partly overlapping a respective first end of a first casing section and a second casing section and said at least one longitudinal part is provided with connection means in order to be connected to said casing sections in a mounted state of the joint element, said casing sections are adapted to move axially relative to said joint element in an operative state. The inventive joint element affords the benefit of allowing the casing string to expand or contract due to thermal effects and/or pressure effects when installed in the well. This will prevent the casing string from deforming, collapsing or buckling in a well bore. The joint element according to the invention can provided with the same outer diameter as the casing collar that is today used to connect the casing sections, and the same inner diameter as the casing sections. This allows for the normal cementing process, which can be done using normal cementing equipment. The joint element can in this way be placed anywhere along the casing string, also directly across the production zone, and can be used as a single unit, or in multiples to allow for the casing movement in the desired position along the casing string. Another benefit of the invention is that it can be cemented in place together with the casing string, still maintaining its function to allow for casing expansion or contraction. According to one beneficial embodiment, said at least one longitudinal part is made of steel.

According to this further beneficial embodiment, said connection means is at least two shear members, a first shear member and a second shear member, with predefined shear values, said first shear member is fixed on said longitudinal part and on the first casing section and said second shear member is fixed on said longitudinal part and on said second casing section, said shear members are adapted to shear when an axial force due to thermal effects exceeding the total shear value of said shear members is exerted, allowing a relative axial movement between each of said first and second casing sections and the longitudinal part. The benefit of this is that the joint element and the casing sections are held together by said at least two shear members. The at least two shear members are also locking the joint element and said casing sections in axial and rotational direction until the casing string is assembled and the joint element is activated by an axial force exceeding the total shear value of said shear member. Hence, axial forces and rotating torques are allowed to be transferred through the element before it is activated. The number of shear members and the material of the shear member can of course be adapted depending on the desired shear force value. A preferred material of the shear member is brass since brass has good shearing qualities, but as mentioned above, it can be adapted for the current situation. Other possible materials can be different types of steel materials, for example low strength or high strength steel.

According to one beneficial embodiment, said connection means is at least two fixing members, a first fixing member and a second fixing member, each with a first end and a second end, said first end of said first fixing member is fastened on the longitudinal part and said second end of said first fixing member is positioned in a longitudinal slot extending in the longitudinal direction of the first casing section thereby restricting the relative movement between longitudinal part and the first casing section, and said first end of said second fixing member is fastened on the longitudinal part and said second end of said second fixing member is positioned in a longitudinal slot extending in the longitudinal direction of the second casing section thereby restricting the relative movement between longitudinal part and the second casing section. The benefit of this is that the relative movement between the casing sections and the joint element will be restricted. Said at least two fixing members will also prevent the casing string from parting once said at least two shear members are sheared. The position of said at least two fixing members can also be modified to adjust the direction and the length of the relative movement between the casing sections and the joint element. Since the at least two fixing members are positioned in a longitudinal slot or a radial cut-out in the first casing section and the second casing section respectively, rotating torques can be carried even after the shear members have been sheared. The fixing members can be positioned to allow for the casing sections to only compress into the joint element, or to allow only them to elongate from the joint element, or any combination of the two, depending on the application. The longitudinal slots can also be a cut out or the like. The number of fixing members and the material of the fixing members can of course be adapted depending on the current application. A preferred material of the shear member is steel, for example high strength steel.

There is also defined in accordance with the present invention a casing string, which according to the invention is characterised in that it comprises at least one casing section and at least one joint element according to the present invention. In this way the casing string can be cemented and axially anchored without running the risk of deforming due to thermal effects.

BRIEF DESCRIPTION OF THE DRAWINGS

Features of the present invention will now be described in more detail with reference to non-limiting exemplifying embodiments and with reference to the accompanying drawings, in which FIG. 1. is a perspective view, partially sectioned, of a joint element according to a first embodiment of the present invention, FIG. 2. is a perspective view, partially sectioned, of the joint element according to a second embodiment of the present invention, FIG. 3. is a side view, partially sectioned, of the joint element according to certain embodiments of the present invention in an assembled and fully expanded position, FIG. 4. is a side view, partially sectioned, of the joint element according to certain embodiments of the present invention in an assembled and fully compressed position, FIG. 5. is a side view, partially sectioned, of the joint element according to a third embodiment of the present invention in assembled position, FIG. 6. is a side view, partially sectioned, of a casing string mounted in a well bore.

DETAILED DESCRIPTION

FIGS. 1 through 12 illustrates different embodiments of the present invention applied on a joint element for a casing string for transporting fluids. It will, however, be emphasized at once that the invention is in no way restricted to this type of joint element, but can be applied to any joint element whatsoever, as long as the object of the invention is obtained.

Figure 1:
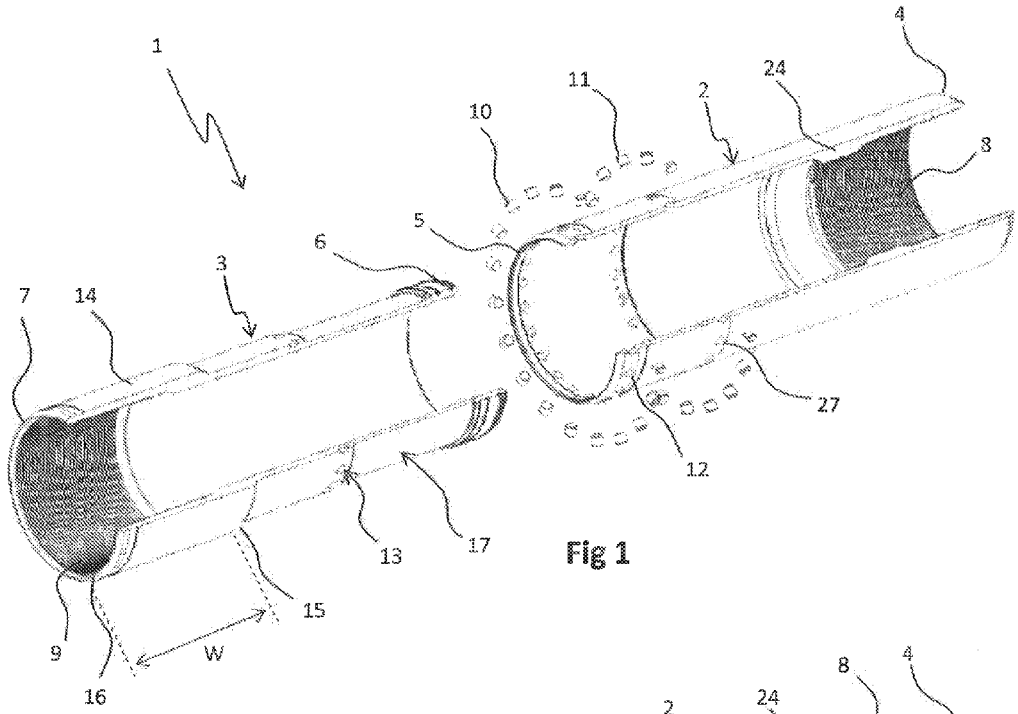

FIG. 1 is a perspective view, partially sectioned, of the joint element 1 according to the present invention. In this case of the illustrated embodiment, the joint element 1 comprises two longitudinal parts 2, 3, a first longitudinal part 2 with a first end 4 and a second end 5 and a second longitudinal 3 part with a first end 6 and a second end 7. The two longitudinal part 2, 3 can be manufactured in any length and material. The first end 4 of the first longitudinal part 2 is provided with a threading 8 on its inner periphery and the second end 7 of the second longitudinal part 3 is also provided with a threading 9 on its inner periphery. The second longitudinal part 3 is provided with a collar 14 with a first end 15 and a second end 16 defining a predefined width W of the collar 14. The diameter of the second end 5 of the first longitudinal part 2 is larger than the first end 6 of the second longitudinal part 3 and hence the first longitudinal part 2 can overlap the second longitudinal part 3 at least partially forming a telescopic function allowing a relative movement of the longitudinal parts 2, 3 in an assembled state. In FIG. 1, said first longitudinal part 2 is adapted to overlap the second longitudinal part 3 in a assembled state of the joint element 1, but of course the two longitudinal parts 2, 3 can be adapted so that the second longitudinal part 3 is overlapping the first longitudinal part 2. The two longitudinal parts 2, 3 of the joint element 1 are held together by a set of shear members 10 and a set of fixing members 11. The shear members are in an assembled state mounted into threaded holes 12 at the second end 5 of the first longitudinal part 2 and are positioned in cut-outs 13 in the second longitudinal part 3, thereby locking the two longitudinal parts 2, 3 in an axial and rotational direction in the assembled state. The joint element 1 is activated when the two longitudinal parts 2, 3 move axially relative each other. The longitudinal parts 2, 3 start to move axially relative each other when the set of shear members 10 are sheared due to a force, exceeding the shear value of the shear members 10, which is normally generated by thermal expansion. The shear value of the shear members 10 is dimensioned to exceed the rotational torque that is needed during assembling of the joint element 1 and the casing sections 25 (see FIG. 6) of the casing string 26 (see FIG. 6). The fixing members 11 are in the assembled state mounted into threaded holes 27 in the first longitudinal part 2 and are positioned in a slot or cut-out 17 in the second longitudinal part 3, thereby restricting the relative movement between the longitudinal parts 2, 3.

Figure 2:
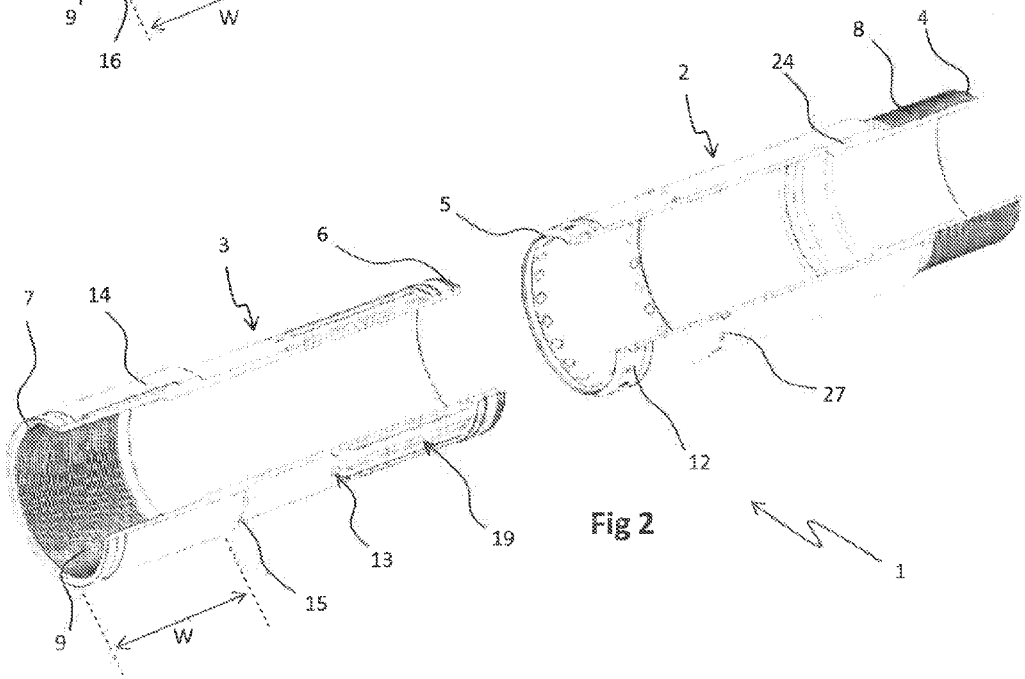

FIG. 2 is a perspective view, partially sectioned, of one embodiment of joint element 1 according to the present invention. In this embodiment, the first end 4 of the first longitudinal part 2 is provided with a threading 8 on its outer periphery and the second end 7 of the second longitudinal part 3 is provided with a threading 9 on it's inner periphery. In an assembled state of the jointing element 1, the shear members (not shown in FIG. 2) are mounted in the cut-outs 13 on the second longitudinal part 3 and the fixing members (not shown in FIG. 2) are mounted into longitudinal slots 19 on the second longitudinal part 3. The relative movement between the two longitudinal parts 2, 3, extending the joint element 1, is thereby restricted by the fixing members 11 in an assembled state. The relative movement between the two longitudinal parts 2, 3, compressing the joint element 1, is restricted by the distance between the first end 15 of the collar 14 of the second longitudinal part 3, and the second end 5 of the first longitudinal part 2. The fixing members 11 will also prevent the joint element 1 from parting once the shear members 10 are sheared. By extending or shortening the length of the first and second longitudinal parts 2, 3, the length of the relative movement can be modified to suit any application. The position of the fixing members 11 in the first longitudinal part 2 can also be modified to adjust the direction and length of the relative movement between the longitudinal parts 2, 3.

Figure 3:
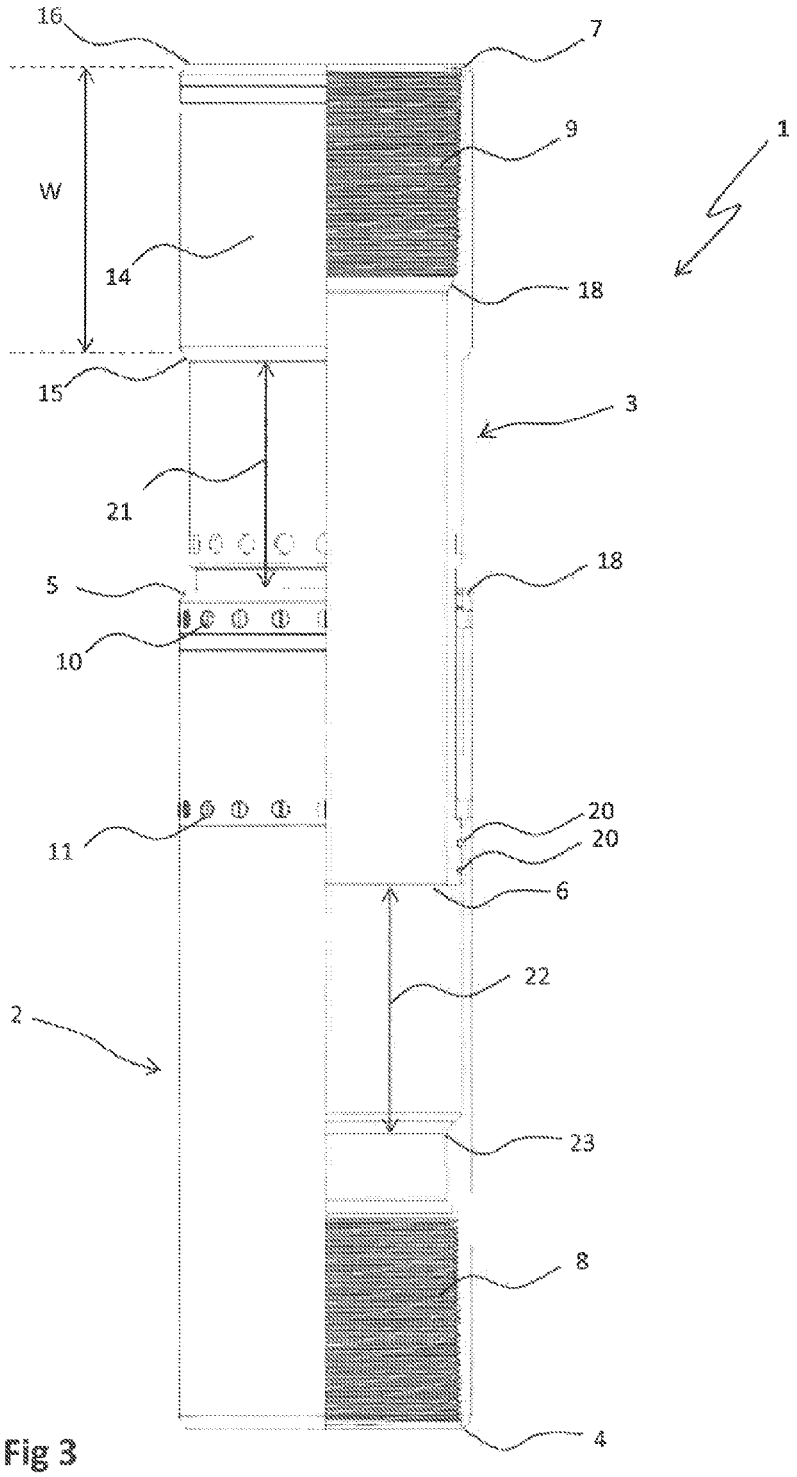

FIG. 3 is a side view, partially sectioned, of the joint element 1 according to the present invention in an assembled and fully expanded position. The first longitudinal part 2 is now partially overlapping the second longitudinal part 3. The two longitudinal parts 2, 3 are held together by a set of shear members 10 and a set of fixing members 11. The two longitudinal parts 2, 3 can move axially relative each other, and a set of elastomeric seals 20 between the two longitudinal parts 2, 3 gives pressure integrity to the joint element 1. The relative movement between said longitudinal parts 2, 3 is achieved by a reduction of the outer diameter of first end 6 of the second longitudinal part 3 compared to the outer diameter of the second end 7 of the second longitudinal part 3 and an increase of the inner diameter of the second end 5 of the first longitudinal part 2 compared to the inner diameter of the first end 4 of the longitudinal part 2 and in that the diameter of the second end 5 of the first longitudinal part 2 is bigger than the first end 6 of the second longitudinal part 3. The relative movement between the two longitudinal parts 2, 3, compressing the joint element 1, is restricted by the distance 21 between the first end 15 of the collar 14 of the second longitudinal part 3 and the second end 5 of the first longitudinal part 2. The relative movement between the two longitudinal parts 2, 3, extending the joint element 1, is restricted by the fixing members 11. Should the joint element 1 be fully compressed by the forces generated by the thermal expansion of the casing string 26 (see FIG. 6), the distance 21 is made smaller than the distance 22. This will secure that the first longitudinal part 2 and the second longitudinal part 3 meets each other at full compression when the distance 21 is reduced to zero, always leaving a gap at the inner portion of the longitudinal parts 2, 3. This will prevent any deformation to the joint element 1, caused by the axial forces from the expanded casing to influence the inner diameter, which might influence the flow path through the joint element 1. The second end 5 of the first longitudinal part 2 and the first end 15 of the collar 14, that meet when the joint element is in the compressed state, are fitted with chamfers 18 to force the hardened cement away from the joint element 1, thereby allowing it to compress even if cemented. An inner end 23 of the first longitudinal part 2 is also fitted with a chamfer to allow for e.g. a cementing wiper plug to pass through without getting stuck.

Figure 4:
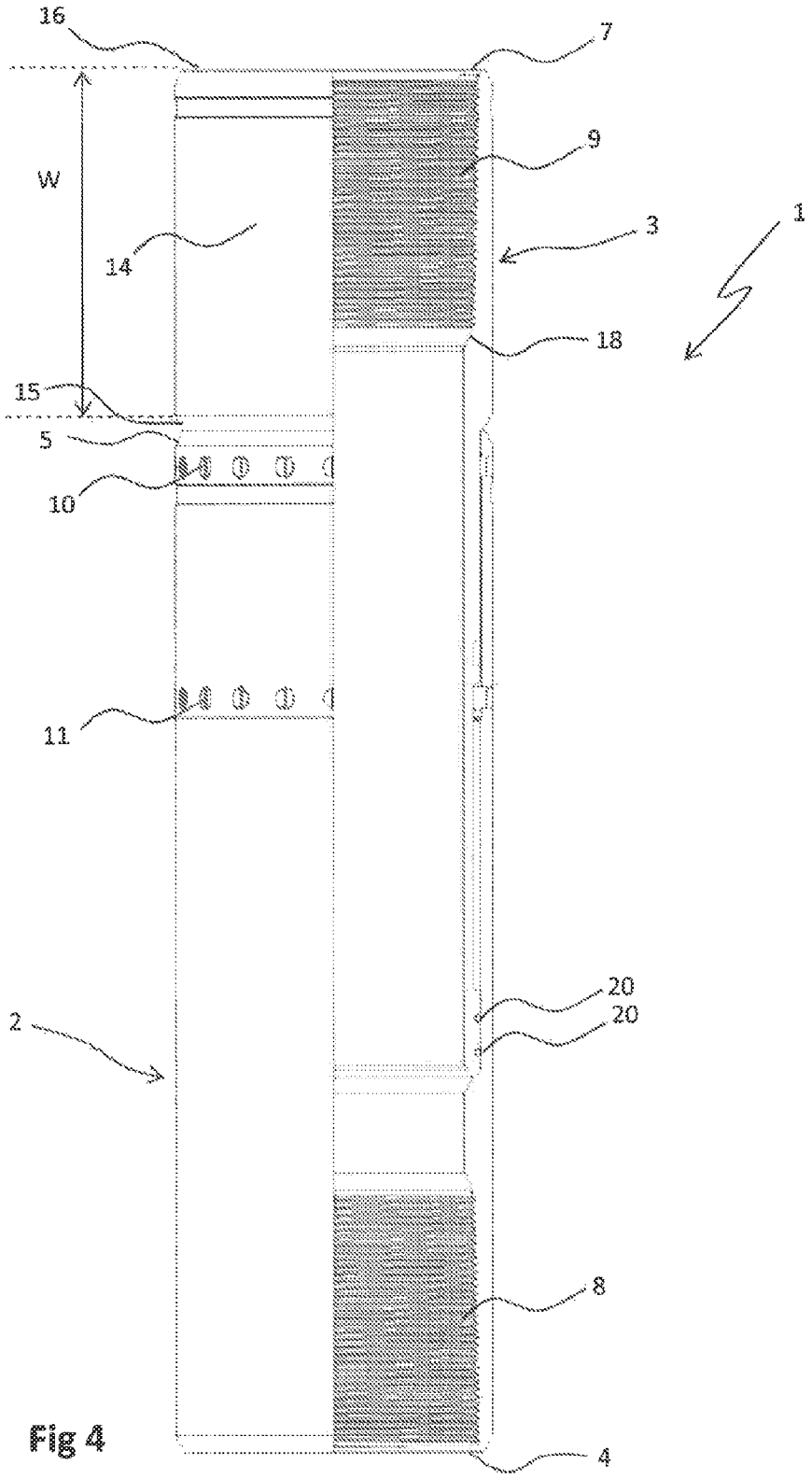

FIG. 4 shows a side view, partially sectioned, of the joint element 1 according to the present invention in an assembled and fully compressed position.

Figure 5:
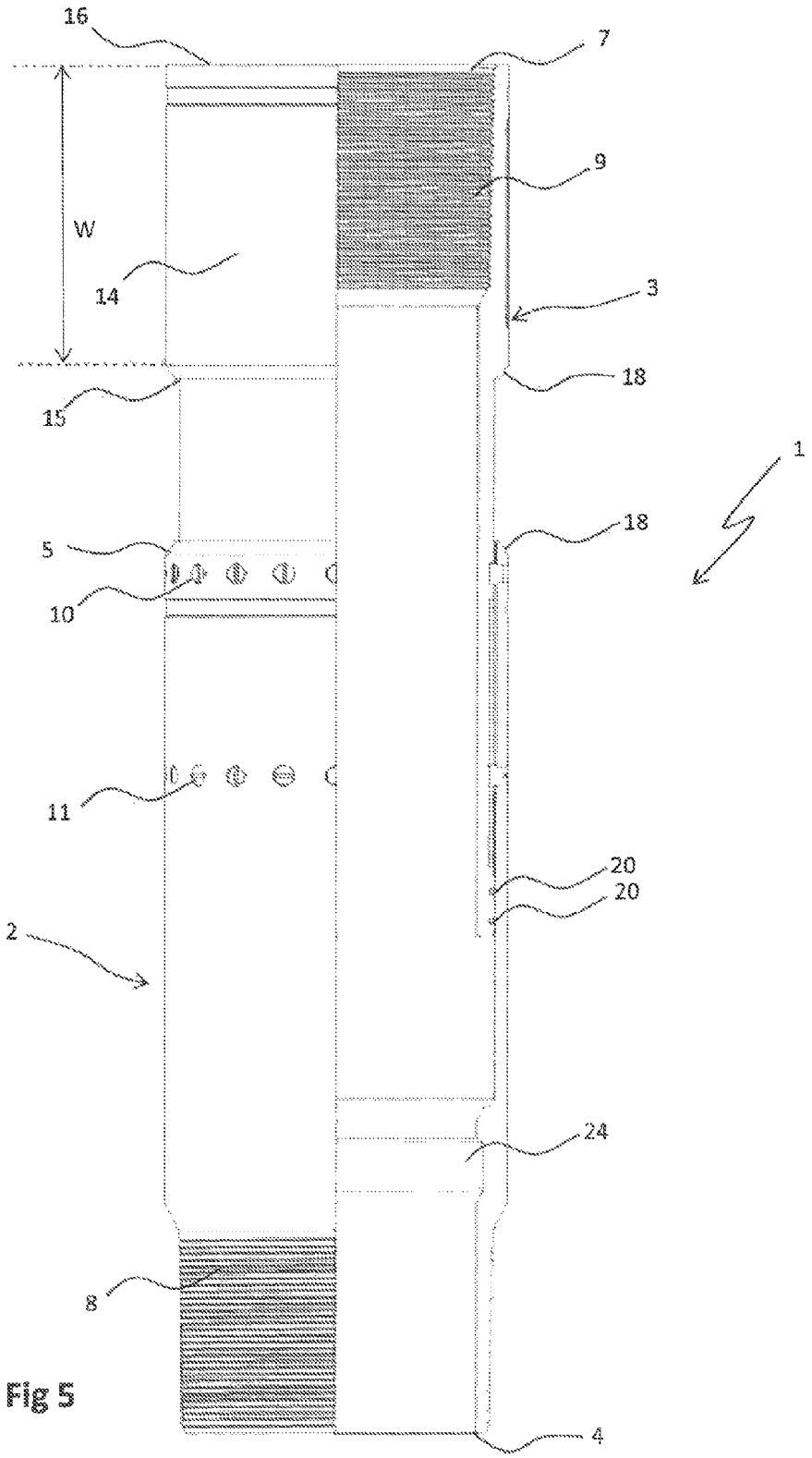

FIG. 5 shows a side view, partially sectioned, of the joint element 1 according to a third embodiment of the present invention in assembled position. This embodiment comprises a receiving means 24 with a fish-neck profile provided in the first longitudinal part 2, which is provided with a threading 8 on the outer periphery of its first end 4.

Figure 6:
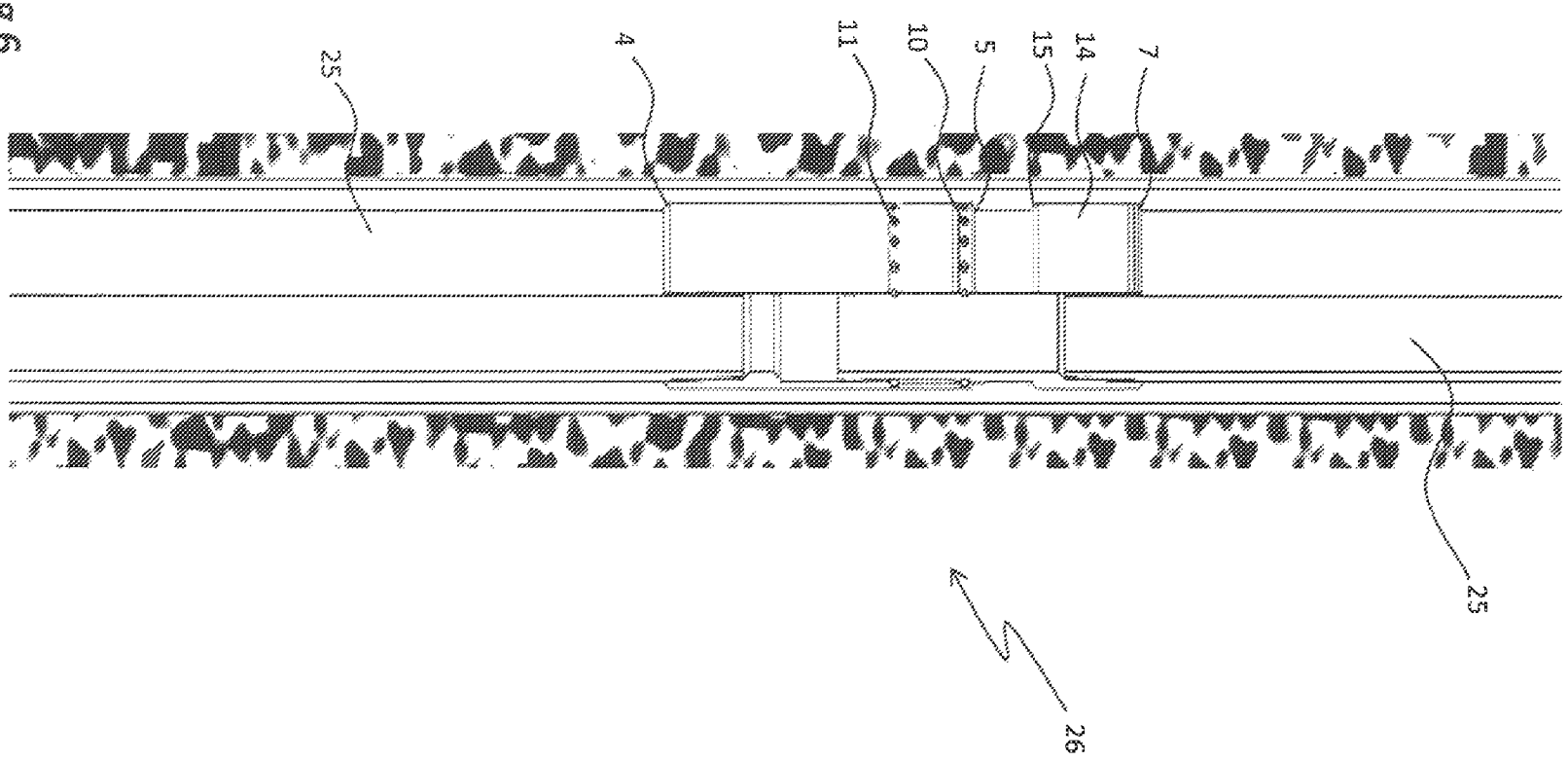

FIG. 6 is a side view, partially sectioned, of a casing string 26 mounted in a well bore. The joint element 1 can be placed anywhere in the casing string 26, replacing a casing collar, and will function after cementing of the casing string 26. The joint element 1 can be provided with the same external diameter as the normally used casing collar, connecting the casing sections 25, and with the same inner diameter as the casing sections 25. It is also fitted with integrated seals to give it pressure integrity. This together will allow for the following cementing operation to be done using normal cementing equipment. The joint element 1 can be connected to the casing sections 25 using the same type of threads as the casing sections 25.

Figure 7:
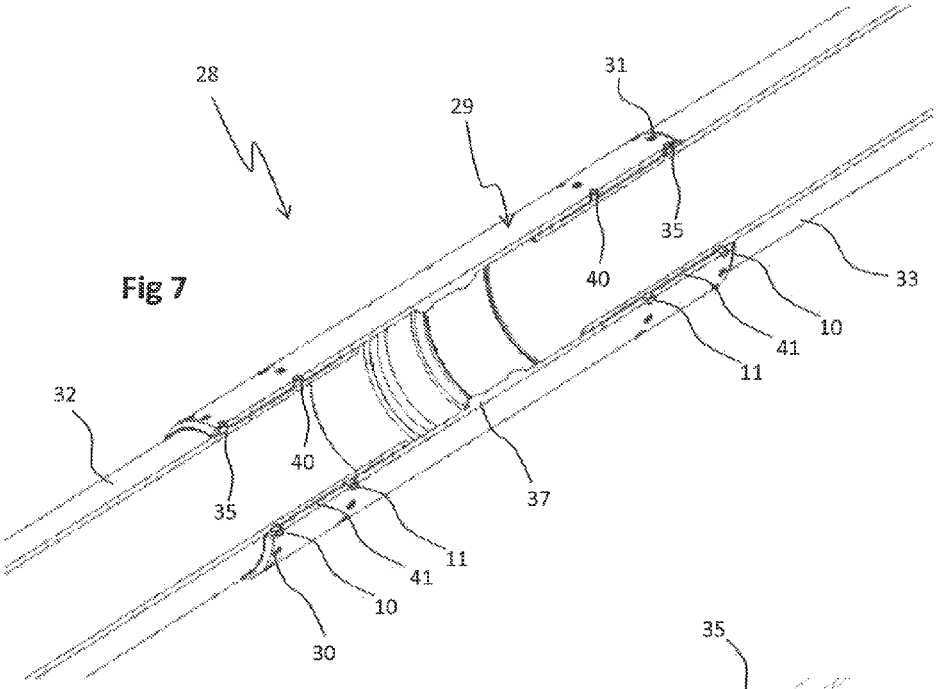
FIG. 7 is a perspective view of another embodiment of a joint element and two casing sections in an exploded view.

FIG. 7 is a perspective view, partially sectioned, of one further embodiment of a casing section joint element 28 according to the invention. In this view, the joint element 28 comprises a longitudinal part 29 with a first end 30 and a second end 31. The longitudinal part 29 can be manufactured in any length and material. The first end 30 of the longitudinal part 29 is in an operative state connected to a first casing section 32 and the second end 31 of the longitudinal part 29 is in an operative state connected to a second casing section 33. The inner diameter of the first end 30 of the longitudinal part 29 is larger than the outer diameter of the first casing section 32 and the inner diameter of the second end 31 of the longitudinal part 29 is larger than the outer diameter of the second casing section 33. Hence, the longitudinal part 29 can overlap the first casing section 32 and the second casing section 33, at least partially, forming a telescopic function allowing a relative movement between the casing sections 32, 33 and the longitudinal part 29 in an assembled state. In FIG. 7, said longitudinal part 29 is adapted to overlap both the first casing section 32 and the second casing section 33, but of course it is also possible to adapt the first and second casing sections 32, 33 so that they overlap the longitudinal part 29 (not shown). The longitudinal part 29 and the first casing section 32 are held together by a first set of shear members 10 and a first set of fixing members 11 and the longitudinal part 29 and the second casing section 33 are held together by a second set of shear members 10 and a second set of fixing members 11. The first and second sets of shear members 10 are in an assembled state mounted into drillings, in this embodiment threaded holes 35 provided in the first and second casing sections 32, 33, thereby locking the two casing sections 32, 33 and the longitudinal part 29 in an axial and rotational direction in an assembled state. The joint element 28 is activated when the first and second casing sections 32, 33 move axially relative to the longitudinal part 29. The first and second casing sections 32, 33 starts to move axially relative to the longitudinal part 29 when the first and second sets of shear members 10 are sheared due to a force, exceeding the shear value of the shear members 10, which force is normally generated by thermal expansion of the casing string 26. The first and second sets of shear members 10 are dimensioned to exceed the rotational torque that is needed during assembling and mounting of the joint element 28 and the casing sections 32, 33 of the casing string 26 (see FIG. 12). The first and second sets of fixing members 11 are in the assembled state mounted into drillings, in this embodiment threaded holes 40 in the longitudinal part 29 and are positioned in first and second sets of longitudinal slots 41 in the first and second casing sections 32, 33 respectively, thereby restricting the relative movement between the first and second casing sections 32, 33 and the longitudinal part 29. The longitudinal part 29 is provided with a collar 37 on its inner periphery. The collar 37 is provided circumferential on the inner periphery and placed in the middle of the longitudinal part 29. The collar restricts the movement of the casing sections 32, 33 when an axial force due to thermal effects causes the first and second casing sections 32, 33 to compress into the longitudinal part 29. The relative movement between the casing sections 32, 33 and the longitudinal part 29 is in a compressed state restricted by said collar 37 or by one of the end positions of the first and second longitudinal slots 36 in the first and second casing sections 32, 33. When an axial force due to thermal effects causes the first and second casing sections 32, 33 to compress into the longitudinal part 29, the relative movement between the first and second casing sections 32, 33 and the longitudinal part 29 is restricted by the fact that an end of the casing sections 32, 33 hits the collar 37 or by the fact that the first and second sets of fixing members 11 reaches a first end position in the longitudinal slots 36 in the first and second casing sections 32, 33. When an axial force due to thermal forces causes the first and second casing sections 32, 33 to be elongated from the longitudinal part 29, the relative movement between the first and second casing sections 32, 33 and the longitudinal part 29 is restricted by the fact that the first and second sets of fixing members 11 reaches a second end position in the longitudinal slots 36 in the first and second casing sections 32, 33. In FIG. 7, the longitudinal part 29 of the casing section joint element 28 is provided with a receiving means, in this case with a fish-neck profile. The receiving means allows the joint element 28 to be retrieved by a pulling tool, if required.

Figure 8:
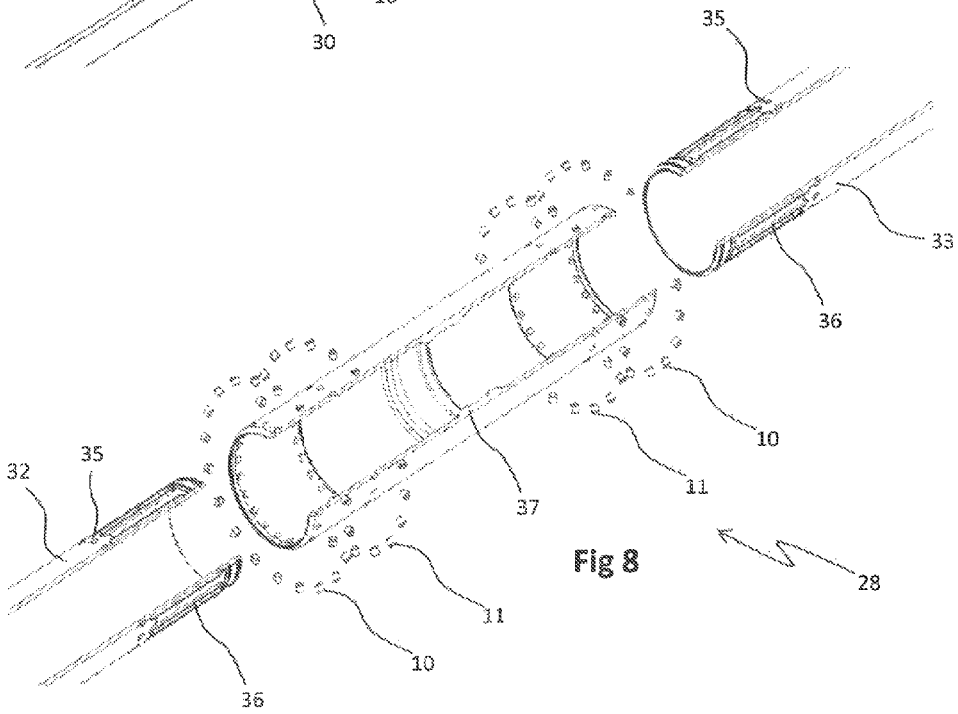
FIG. 8 is a perspective view of the joint element according to certain embodiments of the present invention assembled with two casing sections.

FIG. 8 is a perspective view of the embodiment of the casing section joint element 28 according to FIG. 7 in an assembled state. In the assembled state of the joint element 28, the shear members 10 are mounted in drillings, in this embodiment threaded holes 35 on the first and second casing section 32, 33, respectively, and the fixing members 11 are mounted in first and second sets of longitudinal slots 36 on the first and second casing section 32, 33. The fixing members 11 will also prevent the joint element 28 from parting once the shear members 10 are sheared. By extending or shortening the length of the longitudinal part 29 or the length of the longitudinal slots 36 the length of the relative movement can be modified to suit any application. The position of the fixing members 11 in the first longitudinal part 29 can also be modified to adjust the direction and length of the relative movement between the first and second casing sections 32, 33 and the longitudinal part 29.

Figure 9:
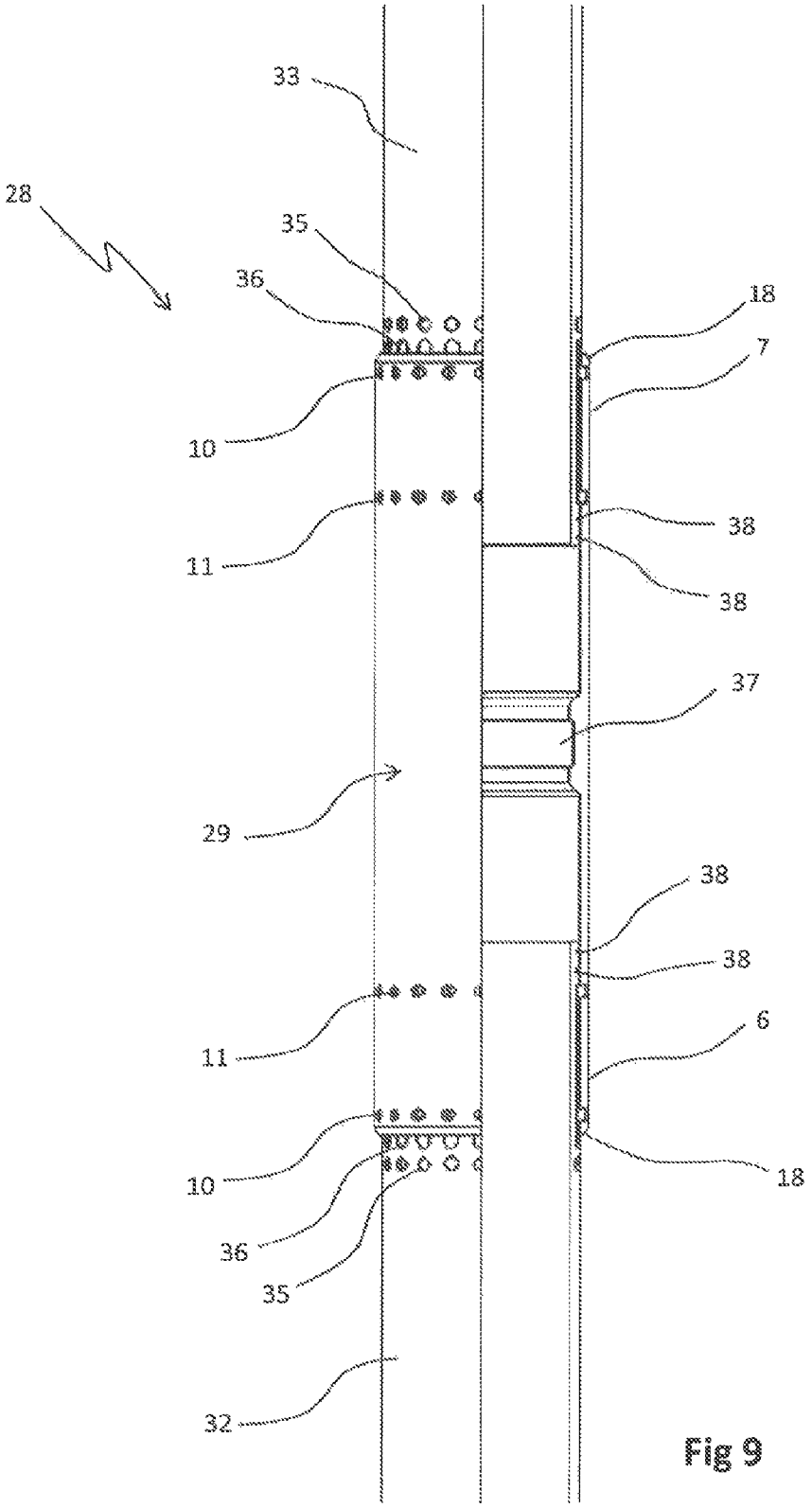
FIG. 9 is a side view of the joint element according to certain embodiments of the present invention in an assembled and fully elongated position.

FIG. 9 is a side view of the joint element 28 according to the present invention in an assembled and fully expanded position. The longitudinal part 29 is now partially overlapping the first casing section 32 and the second casing section 33. The longitudinal part 29 and the first casing section 32 are held together by a first set of shear members 10 and a first set of fixing members 11 and the longitudinal part 29 and the second casing section 33 are held together by a second set of shear members 10 and a second set of fixing members 11. The first and second casing sections 32 and 33 can move axially relative to the longitudinal part 29 of the joint element 28. In FIG. 9 the shear members 10 have been sheared by an axial force due to thermal effects and thereafter the first and second casing section 32, 33 have elongated from the longitudinal part 29 and reached a fully elongated position. The relative movement between the casing sections 32, 33 and the longitudinal part 29 of the joint element 28, extending the casing string 26 is restricted by the fact that fixing members reaches the end position of the longitudinal slots 36. The joint element 28 is further provided with a first set of elastomeric seals 38 between the longitudinal part 29 and the first casing string 32 and a second set of elastomeric seals 38 between the longitudinal part 29 and the second casing string 33, which gives pressure integrity to the joint element 28. The first end 6 and the second end 7 of the longitudinal part 29 are fitted with chamfers 18 to force the hardened cement away from the joint element 28, thereby allowing the casing string 26 to be compressed even if cemented. The ends of the casing sections 32, 33 are also fitted with a chamfer 18 to allow for e.g. a cementing wiper plug to pass through without getting stuck.

Figure 10:
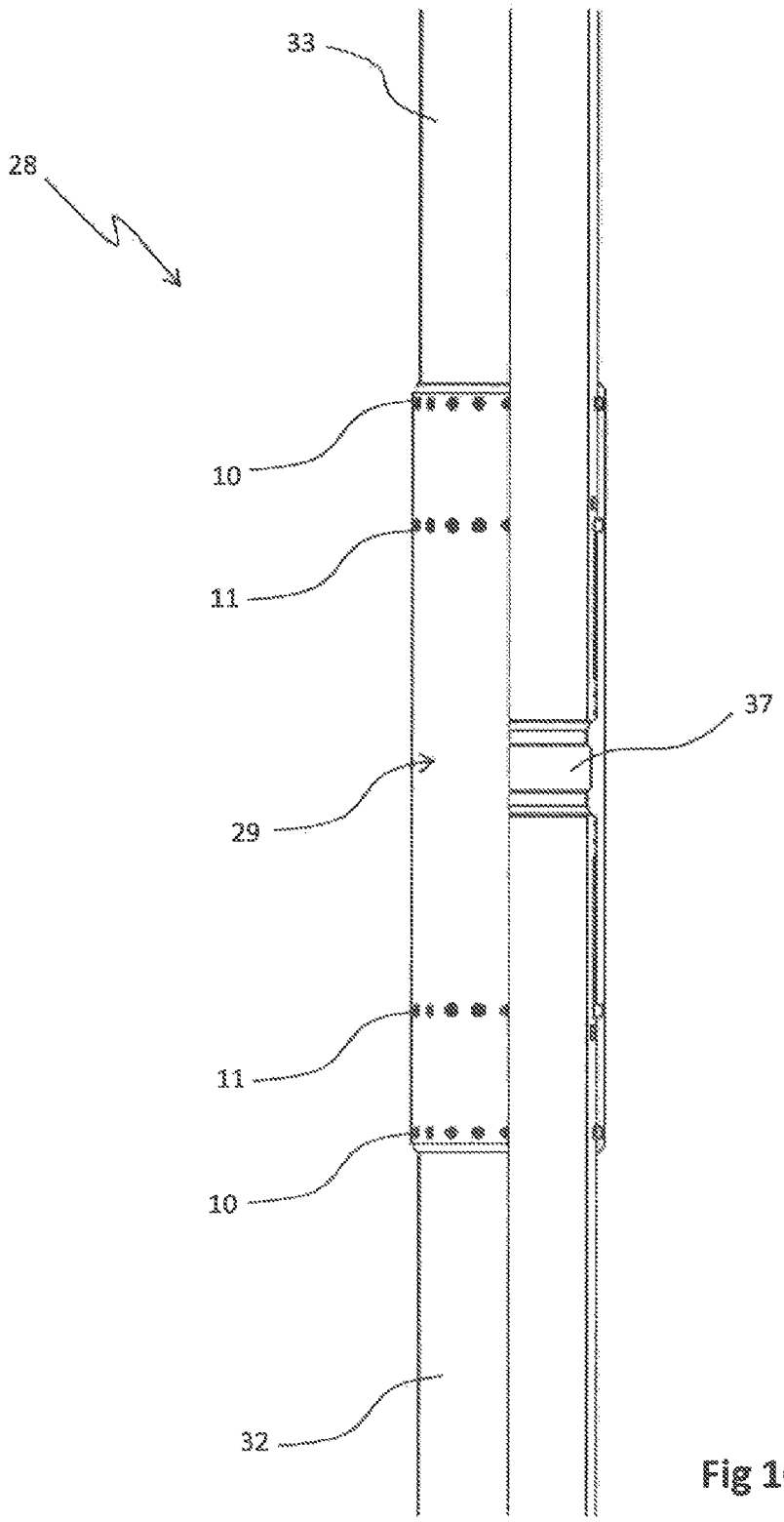
FIG. 10 is a side view of the joint element according to certain embodiments of the present invention in an assembled and fully compressed position.

FIG. 10 shows a side view, partially sectioned, of the joint element 28 according to the present invention in an assembled and fully compressed position. The first and second casing sections 32 and 33 can move axially relative to the longitudinal part 29 of the joint element 28. In FIG. 10 the shear members 10 have been sheared by an axial force due to thermal effects and thereafter the first and second casing section 32, 33 have compressed into the longitudinal part 29 and reached a fully compressed position. The relative movement between the casing sections 32, 33 and the longitudinal part 29 of the joint element 28, compressing the casing string 26 (see FIG. 12), is restricted by the collar 37 provided on the inner periphery of the longitudinal part 29 or by the first and second sets of fixing members 11 reaching the first end position of the longitudinal slots 36.

Figure 11:
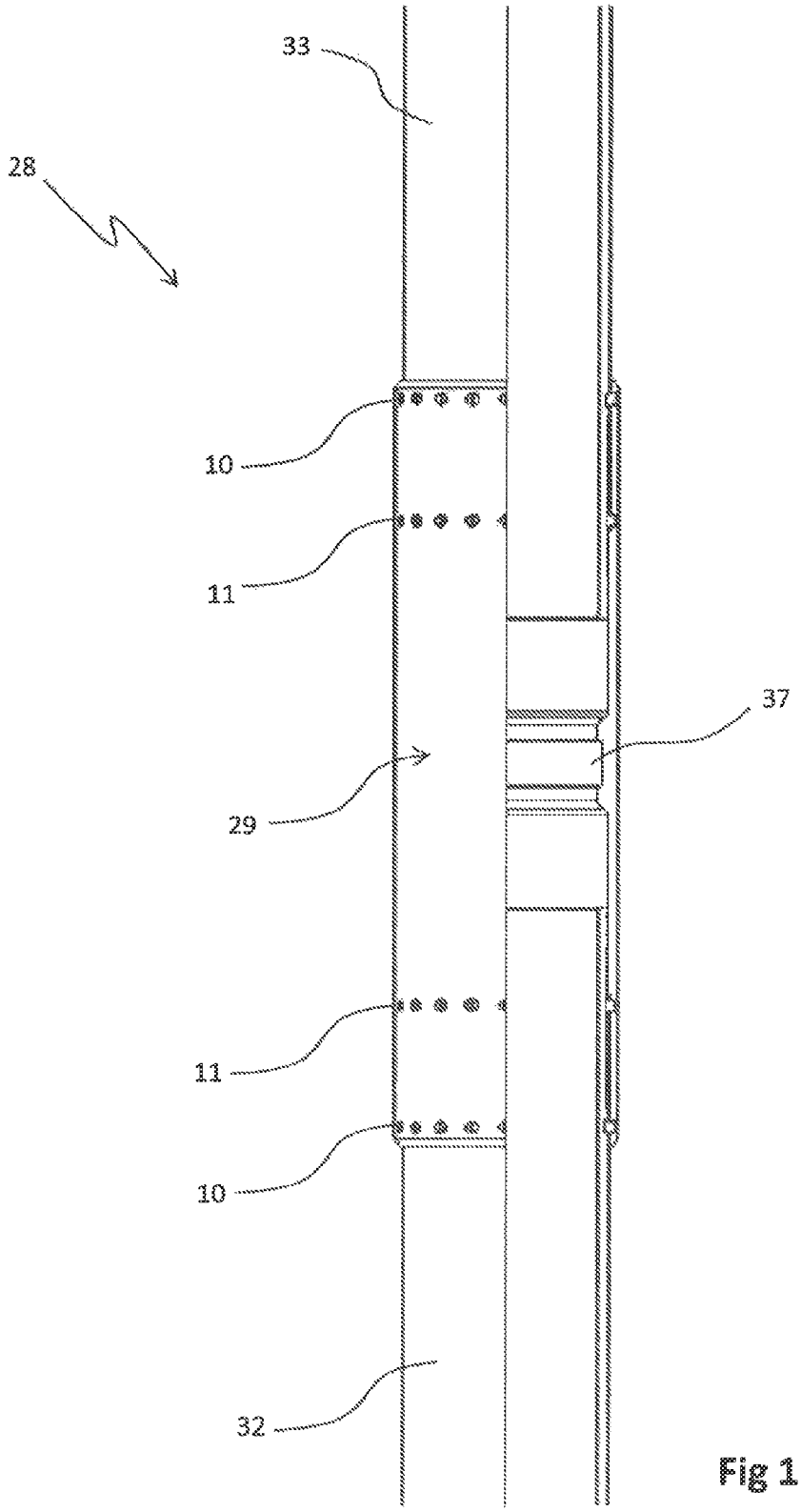
FIG. 11 is a side view of the joint element according to certain embodiments of the present invention in an assembled position.

FIG. 11 shows a side view, partially sectioned, of the joint element 28 according to the present invention in an assembled and a non activated state.

Figure 12:
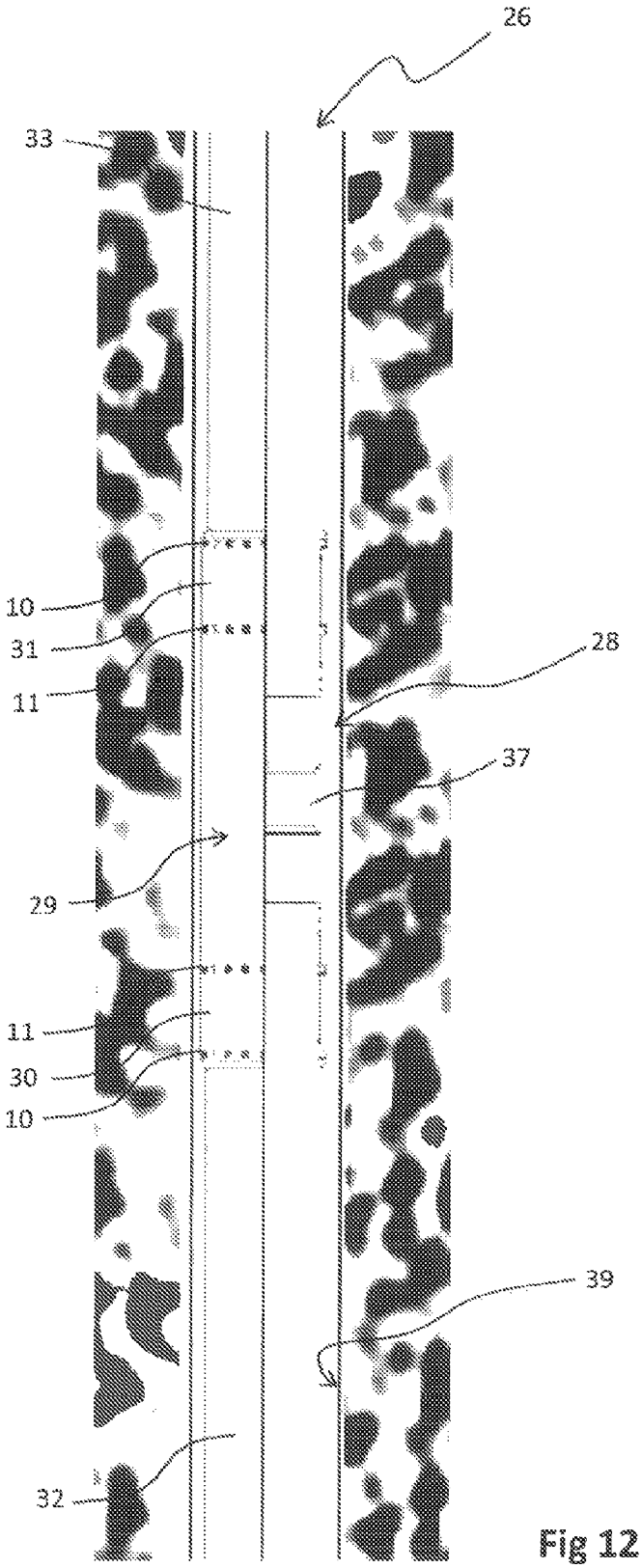
FIG. 12 is a side view of a casing string mounted in a well bore.

FIG. 12 is a side view, partially sectioned, of a casing string 26 mounted in a well bore 39. The joint element 28 can be placed anywhere in the casing string 26, and will also function after cementing of the casing string 26. The joint element 28 can be provided with the same external diameter as the normally used casing collar, connecting the casing sections 32, 33 and with the same inner diameter as the casing sections 32, 33. It is also fitted with integrated seals to give it pressure integrity. This together will allow for the following cementing operation to be done using normal cementing equipment.

The above description is primarily intended to facilitate the understanding of the invention. The invention is of course not limited to the above embodiments but also other variants of the invention are possible and conceivable within the scope of the invention and the appended claims. The invention is of course possible to use in other applications not mentioned here.

What is claimed is:

1. A joint element for connecting casing sections of a casing string for transporting fluids and/or gases and wherein the casing sections and the joint element are configured to be fixed, in a bore hole, wherein the joint element comprises a first end, a second end and a longitudinal part extending between the first end and the second end, the first end arranged to be at least partly overlapping a first casing section, the second end arranged to be at least partly overlapping a second casing section, wherein the longitudinal part is provided with fixing members that are arranged to connect the longitudinal part with the first and second casing sections in a mounted state, wherein the joint element comprises at least one shear member at each of the first end and the second end with a predefined shear value, wherein the at least one shear member is fixed in the longitudinal part and in a corresponding one of the first and second casing sections in the mounted state, and wherein the least one shear member is adapted to shear when an axial force exceeding the predefined shear value of said shear member is exerted, allowing an axial movement of the longitudinal part relative to at least one of the first and second casing sections from the mounted state.

2. The joint element according to claim 1, wherein said joint element is made of steel.

3. The joint element according to claim 1, wherein said at least one shear member is made of brass.

4. The joint element according to claim 1, wherein said longitudinal part comprises at least one fixing member having two ends, wherein a first end of the at least one fixing member is fastened on the longitudinal part, wherein a second end of the at least one fixing member is positioned in a longitudinal slot extending in the longitudinal direction of the first and second casing sections, restricting the relative movements between the longitudinal part and the casing sections.

5. The joint element according to claim 4, wherein said at least one fixing member is made of steel.

6. The joint element according to claim 1, wherein the joint element comprises at least one sealing member provided between said longitudinal part and the casing sections.

7. The joint element according to claim 1, wherein said longitudinal part is provided with a receiving means, allowing the joint element to be retrieved by a pulling tool, if required.

8. The joint element according to claim 7, wherein said receiving means is an internal fish-neck profile.

9. A joint element according to claim 1, wherein that the at least one fixing member is fastened on the longitudinal part and positioned in a longitudinal slot extending in the longitudinal direction of the longitudinal part or the casing sections thereby restricting the relative movement between the longitudinal part and the casing sections.

10. A casing string comprising at least one casing section and the joint element according to claim 1.

11. A method for compensating of forces due to thermal effects in a casing string:

providing a casing string comprising a first casing section, a second casing section and a joint element connecting the first and second casing sections, wherein the joint element comprises a first end, a second end and a longitudinal part extending between the first and second ends, arranging the first casing section, the second casing section and the joint element such that the first end overlaps at least part of the first casing section and such that the second end overlaps at least part of the second casing section, and providing at least one shear member with a predefined shear value at each of the first end and the second end of the joint element, wherein the at least one shear member is fixed in the longitudinal part and in a corresponding one of the first and second casing sections such that forces acting on the casing string due to heat applied to the casing string are compensated by shearing of the at least one shear member in response to a force exceeding the predefined shear value accompanied by axial movement of the longitudinal part relative to at least one of the first and second casing sections.

12. A method according to claim 11, further comprising: restricting the relative movements between the longitudinal part by arranging at least one fixing member with a first end fastened on the longitudinal part and a second end positioned in a longitudinal slot extending in the longitudinal direction of the first and second casing sections.

* * * * *